US010417986B2

(12) United States Patent
Xiong

(10) Patent No.: US 10,417,986 B2
(45) Date of Patent: Sep. 17, 2019

(54) DATA DRIVING SYSTEM OF LIQUID CRYSTAL DISPLAY PANEL

(71) Applicant: Shenzhen China Star Optoelectronics Technology Co., Ltd., Shenzhen, Guangdong (CN)

(72) Inventor: Zhi Xiong, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 192 days.

(21) Appl. No.: 15/127,393

(22) PCT Filed: Jul. 21, 2016

(86) PCT No.: PCT/CN2016/090891
§ 371 (c)(1),
(2) Date: Sep. 19, 2016

(87) PCT Pub. No.: WO2018/006447
PCT Pub. Date: Jan. 11, 2018

(65) Prior Publication Data

US 2018/0218702 A1 Aug. 2, 2018

(30) Foreign Application Priority Data

Jul. 4, 2016 (CN) ..... 2016 1 0519486

(51) Int. Cl.
*G09G 3/36* (2006.01)

(52) U.S. Cl.
CPC ..... *G09G 3/3685* (2013.01); *G09G 2310/08* (2013.01); *G09G 2370/08* (2013.01); *G09G 2370/14* (2013.01)

(58) Field of Classification Search
CPC ..... G09G 3/3685
(Continued)

(56) References Cited

U.S. PATENT DOCUMENTS 5,253,934 A * 10/1993 Potucek ..... B41J 2/45 347/237
5,321,819 A * 6/1994 Szczepanek ..... H04L 29/06 709/228

(Continued)

FOREIGN PATENT DOCUMENTS

CN 101345037 A 1/2009
CN 103531169 A 1/2014

(Continued)

*Primary Examiner* — Prabodh M Dharia
(74) *Attorney, Agent, or Firm* — Andrew C. Cheng

(57) ABSTRACT

A data driving system of a liquid crystal display panel includes a timing control chip; a plurality of data driving chips; a plurality of first signal lines, which is used to transmit a predetermined data signal from the timing control chip to the plurality of data driving chips, each first signal line being provided between the timing control chip and one of the plurality of data driving chips in order to transmit the predetermined data signal from the timing control chip to the plurality of data driving chips; and a plurality of first transmission gates, each of which is provided on one of the plurality of first signal lines. The data driving system can significantly improve the quality of the received signal of the data driving chip, and can effectively avoid the error of the received signal.

20 Claims, 1 Drawing Sheet

(58) Field of Classification Search
USPC ..... 345/98, 100, 204–215; 455/127.1; 600/300
See application file for complete search history.

(56) References Cited

U.S. PATENT DOCUMENTS 6,266,712 B1 * 7/2001 Henrichs ..... G06F 3/0608 710/8
6,281,891 B1 * 8/2001 DaCosta ..... G09G 3/3611 345/204
6,304,241 B1 * 10/2001 Udo ..... G09G 3/3614 345/100
6,897,841 B2 * 5/2005 Ino ..... G02F 1/13452 345/100
8,319,760 B2 * 11/2012 Ino ..... G09G 3/3666 345/204
2003/0117362 A1 * 6/2003 An ..... G09G 3/3688 345/98
2004/0242171 A1 * 12/2004 Hosokawa ..... G09G 3/20 455/127.1
2007/0164970 A1 * 7/2007 Oh ..... G09G 3/2096 345/99
2007/0182691 A1 * 8/2007 Na ..... G02F 1/13452 345/100
2008/0170064 A1 * 7/2008 Lee ..... G09G 3/3677 345/214
2009/0054737 A1 * 2/2009 Magar ..... A61B 5/0205 600/300
2009/0189839 A1 * 7/2009 Ko ..... G09G 3/3648 345/87
2009/0295762 A1 12/2009 Fan
2010/0309392 A1 * 12/2010 Chen ..... G09G 3/3688 348/790
2011/0134093 A1 * 6/2011 Chen ..... G09G 3/3685 345/211
2012/0188214 A1 * 7/2012 Hosokawa ..... G09G 3/20 345/208
2013/0229398 A1 * 9/2013 Lee ..... G09G 3/3614 345/209
2014/0022289 A1 * 1/2014 Lee ..... G09G 3/3283 345/691
2016/0012790 A1 * 1/2016 Zheng ..... G09G 3/3688 345/204
2017/0169757 A1 * 6/2017 Kim ..... G09G 3/2092

FOREIGN PATENT DOCUMENTS

CN 104952408 A 9/2015
CN 105118430 A 12/2015

* cited by examiner

DATA DRIVING SYSTEM OF LIQUID CRYSTAL DISPLAY PANEL

BACKGROUND OF THE DISCLOSURE

1. Field of the Disclosure

The present disclosure relates to a liquid crystal display field, and in particular to a data driving system of a liquid crystal display panel.

2. The Related Arts

The data driving system of a liquid crystal display, LCD, outputs different voltage to change the arranging direction of the liquid crystal molecules, and then to form the gray with different screen through the various light transmittance of each pixel, therefore, at the same time of the continuous optimization of resolution, brightness and response time of the new generation display, the data driving system also requires a higher frequency and higher voltage in order to meet the high scanning frequency and fast update demand, therefore, the amount of chips of the data driving system is also increased.

In the panel driver structure that the X board and the control board of the current liquid crystal display are separated, X board is used to transmit the signal of the control board to the internal source driver IC provided on the liquid crystal display panel. Along with the increase of the amount of data driving chips, the X board is getting longer and longer, resulting that the distance between the distal end of the data driving chip and the proximal end of the data driving chip is too far, thereby causing the discontinuous impedance, making the received signal of the data driving chip worse and worse.

Currently, usually setting terminal resistor in the end of transmission line to improve the quality of the received signal. Otherwise, between the timing control IC, TCON IC, and the data driving chip on the control board adopts the differential signal of mii-LVDS to communicate, the transmitting terminal, TX, of the internal timing control chip transmit a data signal, the data signal is a current signal, the terminal resistor provided in the internal of data driving chip may transfer the current signal to the voltage signal. In order to avoid that the signal is formed a reflected wave in the end of the transmission line to interfere the original signal during the transmission if the differential signal (such as a data current signal, each internal data driving chip is required to provide a terminal resistor. However, since the current data driving system comprises a plurality of data driving chips, the differential current signal outputted in the data driving system will flow to the plurality of data driving chips, therefore, the current of the differential signal received by each data driving chip will decrease, thus reducing the outputted data driving voltage, thereby resulting the abnormal display.

Therefore, a new data driving system of a liquid crystal display panel is urgently required in order to solve the above problem.

SUMMARY OF THE DISCLOSURE

The present disclosure is to provide a data driving system of a liquid crystal display panel, which can significantly improve the quality of the received signal of the data driving chip, and can effectively avoid the error of the received signal.

In order to achieve the above purpose, the present disclosure provides a data driving system of a liquid display panel, which comprises: a timing control chip; a plurality of data driving chips; a plurality of first signal lines, which is used to transmit a predetermined data signal from said timing control chip to said plurality of data driving chips, wherein each first signal line is provided between said timing control chip and a data driving chip in order to transmit said predetermined data signal from said timing control chip to said plurality of data driving chip; a plurality of first transmission gates, wherein each first transmission gate is provided on a first signal line.

In the process of transmitting said predetermined data signal from said timing control chip to said plurality of data driving chip, said plurality of first transmission gates are not turned on simultaneously.

In the process of transmitting said predetermined data signal from said timing control chip to said plurality of data driving chip, said plurality of first transmission gates are sequentially turned on, when each first transmission gate is turned on, the other first transmission gates are turned off.

One of said plurality of data driving chips is in response to receiving a predetermined signal, controlling the first transmission gate on the connected first signal line to be turned on, thereby receiving said predetermined data signal.

The data driving chip which is received said predetermined data signal controls the connected first transmission gate on the first signal line to be turned off, and transmits the control signal to on or more data driving chips of said data driving chip which is not received the predetermined data signal, the data driving chip which is received the control signal controls the connected first transmission gate on the first signal line to be turned on.

Said data driving system also comprises: a plurality of second signal lines, which is used to transmit a clock signal from said timing control chip to said plurality of data driving chips, wherein each second signal line is provided between said timing control chip and a data driving chip in order to transmit said clock signal to said data driving chip; a plurality of second transmission gates, wherein each second transmission gate is provided on a second signal line.

The first transmission gate on the first signal line connected to any one of data driving chip and the second transmission gate on the second signal line connected to any one of data driving chip are simultaneously turned on or off.

Whenever a data driving chip completes acceptance of the clock signal in Nth clock cycle, controlling the connected first transmission gate on the first signal line to be turned off, wherein N is an integer greater than 0.

When the data driving chip which is received the clock signal completes acceptance of the clock signal in Mth clock cycle, outputting the control signal to one or more data driving chips of said data driving chip which is not received the clock signal, wherein M is a positive integer less than N. The data driving chip received the control signal controlling the connected second transmission gate on the second signal line to delay (N−M) clock cycles to be turned on, furthermore, when the data driving chip received the clock signal controlling the first transmission gate on the first signal line to be turned off, the data driving chip received the control signal controlling the connected first transmission gate on the first signal line to be turned on.

One of said plurality of data driving chips is in response to receiving a predetermined signal, controlling the connected second transmission gate on the second signal line to be turned on.

Said clock signal and said predetermined data signal are respectively transmitted in differential signal mode.

The present disclosure provides a data driving system of a liquid crystal display panel, through turning on or off the transmission gate to control whether the signal provided by the timing control chip is transmitted to the data driving chip, furthermore, achieving to time-sharing turn on multiple data driving chips, making the signal provided by the timing control chip successively passed in the data driving chip, avoiding that the data signal provided by the timing control chip flows to a plurality of data driving chips, thereby resulting the decrease of the current of the data signal received by each data driving chip and the reduction of the transferred voltage, which can significantly improve the quality of the received signal of the data driving chip, and can effectively avoid the error of the received signal.

DETAILED DESCRIPTION OF THE PREFERRED EMBODIMENTS

Figure 1:
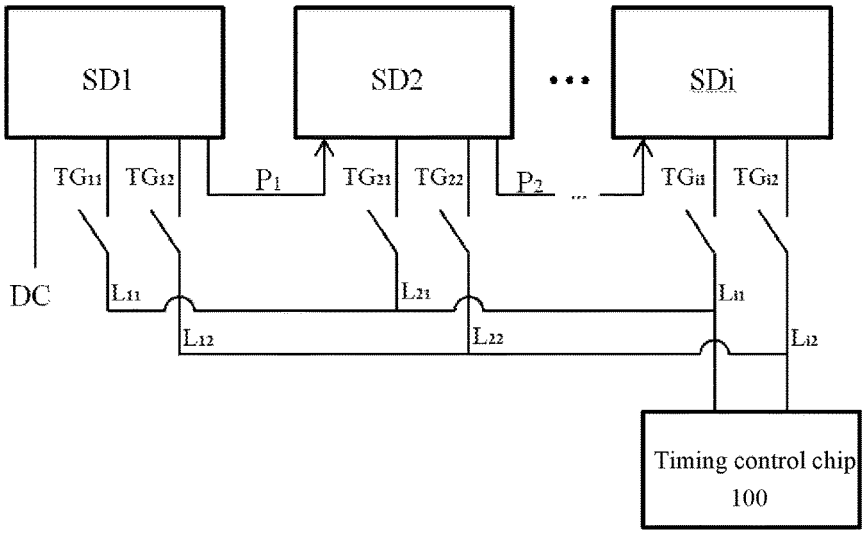
FIG. 1 is a schematic diagram of a data driving system of a liquid crystal display panel of the embodiments of the present disclosure.
Figure 2:
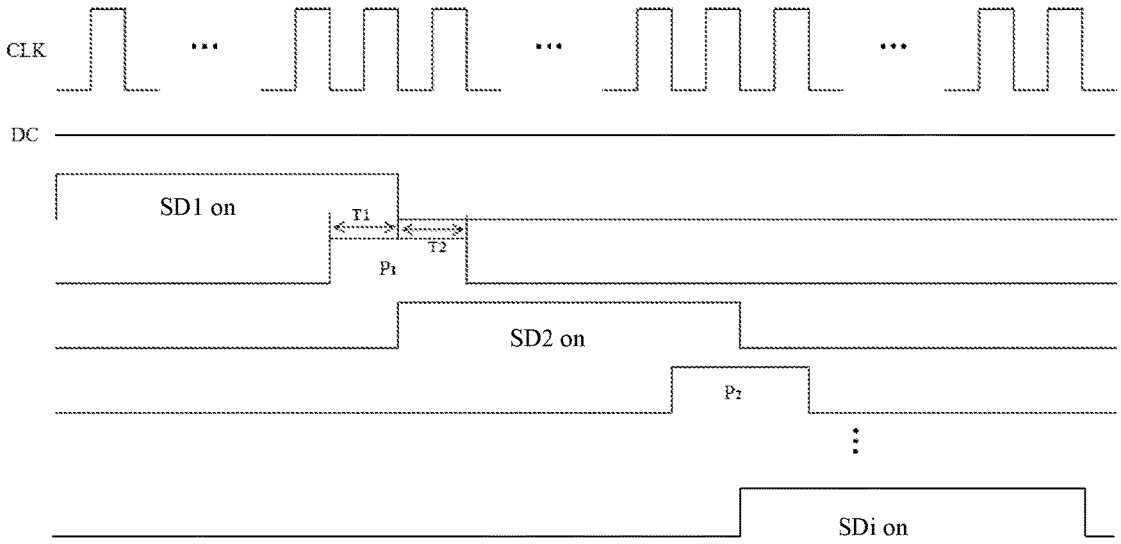
FIG. 2 is a timing chart of the data driving system of the liquid crystal display panel as shown in FIG. 1.

The following will describe the data driving system of the liquid crystal display panel according to the embodiments of the present disclosure refer to FIG. 1 and FIG. 2.

FIG. 1 is a schematic diagram of a data driving system of a liquid crystal display panel of the embodiments of the present disclosure. Refer to FIG. 1, the data driving system of the liquid crystal display panel provided by the embodiments of the present disclosure comprises: a timing control chip 100, a plurality of data driving chips SD1, SD2, . . . , SDi, a plurality of first signal lines $L_{11}$, $L_{21}$, . . . , $L_{i1}$, a plurality of first transmission gates $TG_{11}$, $TG_{21}$, . . . , $TG_{i1}$. Wherein i is a positive integer.

Herein, the timing control chip 100 is provided on the control board, which is used to provide a predetermined data signal and a clock signal that are required when the liquid crystal display panel displays images. Preferably, said predetermined signal and said clock signal are respectively transmitted in the differential signal mode, it should be realized that, in this case, the signal line of the transmitted differential signal respectively comprises a positive line and a negative line.

Said plurality of first signal lines are used to transmit the determined data signal from the timing control chip 100 to said plurality of data driving chips. Each first signal line is provided between the timing control chip 100 and a data driving chip in order to transmit said predetermined signal to said data driving chip. For example, the first signal line $L_{11}$ is provided between the timing control chip 100 and the first data driving chip SD1 in order to transmit said predetermined data signal to said first data driving chip SD1.

Each first transmission gate is provided on a first signal line. Herein, each first transmission gate controls whether the first signal line thereof transmits the predetermined data signal to the data driving chip connected with the first signal line. For example, the first transmission gate $TG_{11}$ is provided on the first signal line $L_{11}$, when the first transmission gate $TG_{11}$ is turned on, the first signal line $L_{11}$ transmits the predetermined data signal to the first data driving chip SD1 connected with the first signal line $L_{11}$; when the first transmission gate is turned off, the first signal line $L_{11}$ can not transmit the predetermined data signal to the first data driving chip SD1 connected with the first signal line $L_{11}$.

Preferably, the first transmission gate is CMOS transmission gate, two control ends of said CMOS transmission gate are connected to the internal circuit of the data driving chip, the input end and the output end of the CMOS transmission gate are connected with the first signal line. It should be realized that, the first transmission gate of the present embodiment is merely exemplary, which can be achieved by the other transmission gate.

In the process of transmitting said predetermined data signal from the timing control chip 100 to said plurality of data driving chips, said plurality of first transmission gates are sequentially turned on, and when each first transmission gate is turned on, the other transmission gates are turned off. Namely, there is only one first transmission gate turned on at one time, thereby the first signal line in the first transmission gate transmits the predetermined data signal to the connected data driving chip, in the case, there is only the data driving chip receiving the predetermined data signal provided by the timing control chip 100, therefore, said predetermined data signals flow to the data driving chip, significantly improving the quality of the received signal of the data driving chip. It should be realized that, in the process of said plurality of first transmission gates sequentially turned on, each predetermined data signal received by the data driving chip is the same as the data signal provided by the timing control chip 100.

However, the present disclosure is not limited by this, it should be realized that, in the process of transmitting said predetermined data signal from the timing control chip 100 to said plurality of data driving chips, said plurality of first transmission gates can not be simultaneously turned on. Namely, in the process of transmitting said predetermined data signal from the timing control chip 100 to said plurality of data driving chips, there is only part of first transmission gates turned on, namely, there is not all the first transmission gates turned on, therefore, there is not all the data driving chips receiving the predetermined data signal provided by the timing control chip 100, which can avoid that the data signal flows to a plurality of data driving chips, thereby resulting the decrease of the current of the data signal received by each data driving chip and the reduction of the transferred voltage. It should be realized that, when said plurality of transmission gate are not simultaneously turned on, the predetermined data signal received by the part of data driving chips is the same as the data signal provided by the timing control chip 100.

In the present embodiment, one of said plurality of data driving chips is in response to receiving the predetermined, controlling the first transmission gate of the connected first signal line, thereby receiving said predetermined data signal. Preferably, said predetermined signal is direct voltage DC. Namely, the data driving chip received the predetermined signal receives the predetermined data signal provided by the timing control chip at first.

The data driving chip received the predetermined data signal controls the first transmission gate of the connected first signal line to be turned off, and outputs the control signal to a data driving chip of the data driving chips not received the predetermined signal; the data driving chip received the control signal controls the first transmission gate of the connected first signal line to be turned on. Sequentially continuing this process, until the last data driving chip receives the predetermined data signal.

For example, the first data driving chip SD1 is in response to receiving the predetermined signal, controlling the first transmission gate $TG_{11}$ of the connected first signal line $L_{11}$ to be turned on, thereby receiving said predetermined data signal; the first data driving chip SD1 controls the first transmission gate $TG_{11}$ of the connected first signal line $L_{11}$ to be turned off, and outputs the control signal P1 to the second data driving chip SD2 not received the predetermined data signal, the second data driving chip SD2 controls the first transmission gate $TG_{21}$ of the connected first signal line $L_{21}$ to be turned on in order to receive the predetermined data signal; the second data driving chip SD2 controls the first transmission gate $TG_{21}$ of the connected first signal line $L_{21}$ to be turned off, and outputs the control signal P2 to the third data driving chip (not shown) not received the predetermined data signal; the third data driving chip controls the first transmission gate (not shown) of the connected first signal line (not shown) to be turned on in order to receive the predetermined signal. Sequentially continuing this process, until the last data driving chip (namely ith data driving chip SDi) controls the first transmission gate $TG_{i1}$ of the first signal line $L_{i1}$ to be turned on, thereby receiving the predetermined data signal. It should be realized that, the signal transmission process of the plurality of data driving chips provided by the present embodiment is merely exemplary, the present disclosure is not limited by this.

However, the present disclosure is not limited by this, it should be realized that, the data driving chip received the predetermined signal controls the first transmission gate of the connected first signal line to be turned off, which also can output the control signal to the plurality of data driving chips of said data driving chip not received the predetermined data signal; the plurality of data driving chips received the control signal control the first transmission gates of the connected first signal lines to be turned on. Sequentially continuing this process, until all the data driving chips receiving the predetermined data signals. Namely, the data driving chip received the predetermined data signal outputs the control signal to the part of data driving chips of said data driving chip not received the predetermined data signal, the part of data driving chips control the first transmission gates of the connected first signal lines to be turned on, thereby transmitting said predetermined data signal from the timing control chip 100 to the part of data driving chips. Sequentially continuing this process, achieving that the part of data driving chips received the predetermined data signal and the part of data driving chips of the plurality of data driving chips not received the predetermined data signal are sequentially turned on through controlling the control signal, until all the data driving chips receiving the predetermined data signal.

For example, the first data driving chip SD1 and the second data driving chip SD2 received the predetermined data signals respectively output the first control signal P1 and the second control signal P2 to the third data driving chip SD3 (not shown) and the fourth data driving chip SD4 (not shown) not received the predetermined data signals, the third data driving chip SD3 and the fourth data driving chip SD4 respectively control the first transmission gates of the connected first signal lines to be simultaneously turned on, thereby receiving said predetermined data signal provided by the timing control chip 100. The third data driving chip SD3 and the fourth data driving chip SD4 respectively control the first transmission gates of the connected first signal lines to be simultaneously turned off, and respectively output the third control signal P3 (not shown) and the fourth control signal P4 (not shown) to the fifth data driving chip SD5 (not shown) and the sixth data driving chip SD6 (not shown) not received the predetermined data signals, the fifth data driving chip SD5 and the sixth data driving chip SD6 respectively control the first transmission gates of the connected first signal lines to be simultaneously turned on, thereby receiving said predetermined data signal provided by the timing control chip 100. It should be realized that, the signal transmission process of sequentially and simultaneously turning on two data driving chips provided by the present embodiment is merely exemplary, the present disclosure is not limited by this.

The following will describe in detail the specific process of time-sharing and individually turning on the data driving chips in the data driving system provided by the present disclosure in order to receive the signal provided by the timing control chip.

In the present embodiment, said data driving system also comprises: a plurality of second signal lines $L_{12}$, $L_{22}$, . . . , $L_{i2}$ and a plurality of second transmission gates $TG_{12}$, $TG_{22}$, . . . , $TG_{i2}$. Wherein i is a positive integer.

Said plurality of second signal lines are used to transmit the clock signal from the timing control chip 100 to said plurality of data driving chip. Each second signal line is provided between the timing control chip and a data driving chip in order to transmit said clock signal to said data driving chip. For example, the second signal line $L_{12}$ is provided between the timing control chip and the first data driving chip SD1 in order to transmit said clock signal to said first data driving chip SD1.

Each second transmission gate is provided on a second signal line. Herein, each second transmission gate controls that whether the second signal line thereof transmits the clock signal to the data driving chip connected with the second signal line. For example, the second transmission gate $TG_{12}$ is provided on the second signal line $L_{12}$, when the second transmission gate $TG_{12}$ is turned on, the second signal line $L_{12}$ transmits the clock signal to the first data driving chip SD1 connected with the second signal line $L_{12}$; when the second transmission gate is turned off, the second signal line $L_{12}$ can not transmit the clock signal to the first data driving SD1 connected with the second signal line $L_{12}$.

Preferably, the second transmission gate is CMOS transmission gate, two control ends of the CMOS transmission gate are connected to the internal circuit of the data driving chip, the input end and the output end of the CMOS transmission gate are connected with the second signal line. It should be realized that, the second transmission gate of the present embodiment is merely exemplary, which also can be achieved through the other transmission gates.

In the present embodiment, the first transmission gate on the first signal line connected with any one of data driving chips and the second transmission gate on the second signal line connected with any one of data driving chips are simultaneously turned on or off. Namely, any one of data driving chips controls the first transmission gate on the connected first signal line and the second transmission gate on the connected second signal line to be simultaneously turned on or off, thereby receiving the predetermined data signal provided by the timing control chip 100 and the clock signal of N clock cycles, wherein N is an integer greater than 0.

One of said plurality of data driving chips is in response to receiving the predetermined signal, controlling the second transmission gate on the connected second signal line to be turned on. Namely, the data driving chip received the predetermined signal receives the predetermined data signal and the clock signal provided by the timing control chip 100 at first.

Whenever a data driving chip completes acceptance of the clock signal in Nth clock cycle, controlling the connected first transmission gate on the first signal line to be turned off. Namely, the timing control chip 100 provides the clock signal, the corresponded time in N clock cycles of the clock signal is the on-time of the data driving chip received the clock signal of N clock cycles, when completing acceptance of the clock signal in Nth clock cycle, the data driving chip is turned off.

In the present embodiment, when the data driving chip which is received the clock signal completes acceptance of the clock signal in Mth clock cycle, outputting the control signal to a driving chip of said data driving chip which is not received the clock signal, wherein M is a positive integer less than N. The data driving chip received the control signal controlling the connected second transmission gate on the second signal line to delay (N−M) clock cycles to be turned on, furthermore, when the data driving chip received the clock signal controlling the first transmission gate on the first signal line to be turned off, the data driving chip received the control signal controlling the connected first transmission gate on the first signal line to be turned on. Sequentially continuing this process, until the last data driving chip receiving the predetermined signal and the clock signal. Namely, when a data driving chip received the predetermined data signal is turned off, the other data driving chip not received the predetermined data signal is immediately turned on, thereby achieving that the plurality of data driving chips are time-sharing and sequentially turned on, moreover, when a data driving chip is turned on, the other data driving chips are turned off.

However, the present disclosure is not limited by this, it should be realized that, when the data driving chip which is received the clock signal completes acceptance of the clock signal in Mth clock cycle, outputting the control signal to a plurality of data driving chips of said data driving chip which is not received the clock signal, wherein M is a positive integer less than N. The data driving chip received the control signal controlling the connected second transmission gate on the second signal line to delay (N−M) clock cycles to be turned on, furthermore, when the data driving chip received the clock signal controlling the first transmission gate on the first signal line to be turned off, the data driving chip received the control signal controlling the connected first transmission gate on the first signal line to be turned on. Sequentially continuing this process, until all the data driving chips are received the predetermined data signal and the clock signal. Namely, when the data driving chip which is received the clock signal completes acceptance of the clock signal in Mth clock cycle, outputting the control signal to the part of data driving chips of said data driving chip which is not received the clock signal, the part of data driving chips control the second transmission gate on the connected second signal line to delay (N−M) clock cycles to be turned on. Sequentially continuing this process, through the control signal to achieve that, when the part of data driving chips received the clock signal are turned off, the part of data driving chips not received the clock signal are turned on, until all the data driving chips are received the predetermined signal and the timing control signal.

FIG. 2 is a timing chart of the data driving system of the liquid crystal display panel as shown in FIG. 1.

Refer to FIG. 2, the first data driving chip SD1 is in response to receiving the direct voltage DC, controlling the first transmission gate $TG_{11}$ on the connected first signal line $L_{11}$ and the second transmission gate $TG_{12}$ on the connected second signal line $L_{12}$, thereby receiving said predetermined data signal and the clock signal CLK in N clock cycles, and when completing to receive the clock signal in Nth clock cycle, controlling the first transmission gate $TG_{11}$ on the connected first signal line $L_{11}$ to be turned off. When the first data driving chip SD1 completes acceptance of the clock signal in Mth clock cycle (meanwhile, the clock signals of (N−M) clock cycles have not been received, the (N−M) clock cycles are remarked as T1), outputting the control signal $P_1$ to the second data driving chip SD2 not received the second signal line $L_{22}$; the second data driving chip SD2 controls the second transmission gate $TG_{22}$ on the connected second signal line $L_{22}$ to delay (N−M) clock cycles to be turned on (the delayed (N−M) clock cycles are remarked as T2, and T1=T2), thereby when the first data driving chip completes acceptance of the clock signal in Nth clock cycle (namely, when the first data driving chip SD1 controls the first transmission gate $TG_{11}$ on the connected first signal line $L_{11}$ to be turned off), the second data driving chip SD2 received the control signal $P_1$ controls the first transmission gate $TG_{21}$ of the connected first signal line $L_{21}$ to be turned on, thereby receiving said predetermined data signal and the timing signals CLK in N clock cycles, and when completing acceptance of the clock signal in Nth clock cycle, the second data driving chip SD2 controls the first transmission gate $TG_{21}$ on the connected signal line $L_{21}$ to be turned off, and outputting the control signal $P_2$ to the third data driving chip (not shown) not received the predetermined data signal; the third data driving chip controls the first transmission gate (not shown) on the connected first signal line (not shown) to be turned on. It should be realized that, each data driving chip is simultaneously received the predetermined data signal and the clock signal.

Sequentially continuing this process, until the last data driving chip SDi receiving the predetermined data signal and the clock signal, thus achieving to time-sharing and individually turn on the data driving chip, significantly improving the quality of the received signal of the data driving chip, and can effectively avoid the error of the received signal.

Adopting the data driving system of the liquid crystal display panel according to the embodiments of the present disclosure, through turning on or off the transmission gate to control whether the signal provided by the timing control chip is transmitted to the data driving chip, furthermore, achieving to time-sharing turn on multiple data driving chips, making the signal provided by the timing control chip successively passed in the data driving chip, avoiding that the data signal provided by the timing control chip flows to a plurality of data driving chips, thereby resulting the decrease of the current of the data signal received by each data driving chip and the reduction of the transferred voltage, which can significantly improve the quality of the received signal of the data driving chip, and can effectively avoid the error of the received signal.

The preferred embodiments according to the present invention are mentioned above, which cannot be used to define the scope of the right of the present invention. Those variations of equivalent structure or equivalent process according to the present specification and the drawings or directly or indirectly applied in other areas of technology are considered encompassed in the scope of protection defined by the claims of the present invention.

What is claimed is:

1. A data driving system of a liquid crystal display panel, comprising:

a timing control chip;

a plurality of data driving chips;

a plurality of first signal lines, which transmit a predetermined data signal from said timing control chip to said plurality of data driving chips, wherein each of said plurality of first signal lines is connected between said timing control chip and a respective one of said plurality of data driving chips in order to transmit said predetermined data signal from said timing control chip to said plurality of data driving chips;

a plurality of first transmission gates, wherein each of said plurality of first transmission gates is provided on a respective one of said plurality of first signal lines and is connected between the respective one of said plurality of first signal lines and a respective one of the plurality of data driving chips;

wherein said plurality of first transmission gates are connected, through said first signal lines, between said timing control chip and said plurality of data driving chips and said plurality of first transmission gates are controlled by said plurality of data driving chips to turn on and off, wherein said plurality of first transmission gates, when turned on, allow transmission of said predetermined data signal from said timing control chip, through said first signal lines, to said plurality of data driving chips.

2. The data driving system of a liquid crystal display panel as claimed in claim 1, wherein in a process of transmitting said predetermined data signal from said timing control chip to said plurality of data driving chips, said plurality of first transmission gates are not turned on simultaneously.

3. The data driving system of a liquid crystal display panel as claimed in claim 2, wherein in the process of transmitting said predetermined data signal from said timing control chip to said plurality of data driving chips, said plurality of first transmission gates are sequentially turned on, and when each first transmission gate is turned on, the other first transmission gates are turned off.

4. The data driving system of a liquid crystal display panel as claimed in claim 3, wherein one of said plurality of data driving chips is, in response to receiving a predetermined signal, controlling the first transmission gate on the first signal line connected thereto to be turned on, thereby receiving said predetermined data signal.

5. The data driving system of a liquid crystal display panel as claimed in claim 3, wherein one of said plurality of data driving chips that receives said predetermined data signal controls the first transmission gate on the first signal line connected thereto to be turned off after receiving said predetermined data signal, and transmits a control signal therefrom to one or more data driving chips of said plurality of data driving chips that do not receive said predetermined data signal, such that the one or more data driving chips of said plurality of data driving chips that receive the control signal controls the first transmission gate on the first signal line connected thereto to be turned on.

6. The data driving system of a liquid crystal display panel as claimed in claim 5, wherein said data driving system also comprises:

a plurality of second signal lines, which transmit a clock signal from said timing control chip to said plurality of data driving chips, wherein each of said plurality of second signal lines is connected between said timing control chip and a respective one of said plurality of data driving chips in order to transmit said clock signal to said plurality of data driving chips; and a plurality of second transmission gates, wherein each of said plurality of second transmission gates is provided on a respective one of said plurality of second signal lines.

7. The data driving system of a liquid crystal display panel as claimed in claim 6, wherein the first transmission gate on the first signal line connected to one of said plurality of data driving chips and the second transmission gate on the second signal line connected to the one of said plurality of data driving chips are simultaneously turned on or off.

8. The data driving system of a liquid crystal display panel as claimed in claim 7, wherein each of said plurality of data driving chips, after receiving an Nth clock cycle of the clock signal, controls the first transmission gate on the first signal line connected thereto to be turned off, wherein N is an integer greater than 0.

9. The data driving system of a liquid crystal display panel as claimed in claim 2, wherein one of said plurality of data driving chips that receives said predetermined data signal controls the first transmission gate on the first signal line connected thereto to be turned off after receiving said predetermined data signal, and transmits a control signal therefrom to one or more data driving chips of said plurality of data driving chips that do not receive said predetermined data signal, such that the one or more data driving chips of said plurality of data driving chips that receive the control signal controls the first transmission gate on the first signal line connected thereto to be turned on.

10. The data driving system of a liquid crystal display panel as claimed in claim 9, wherein said data driving system also comprises:

a plurality of second signal lines, which transmit a clock signal from said timing control chip to said plurality of data driving chips, wherein each of said plurality of second signal lines is connected between said timing control chip and a respective one of said plurality of data driving chips in order to transmit said clock signal to said plurality of data driving chips; and a plurality of second transmission gates, wherein each of said plurality of second transmission gates is provided on a respective one of said plurality of second signal lines.

11. The data driving system of a liquid crystal display panel as claimed in claim 10, wherein the first transmission gate on the first signal line connected to one of said plurality of data driving chips and the second transmission gate on the second signal line connected to the one of said plurality of data driving chips are simultaneously turned on or off.

12. The data driving system of a liquid crystal display panel as claimed in claim 11, wherein each of said plurality of data driving chips, after receiving an Nth clock cycle of the clock signal, controls the first transmission gate on the first signal line connected thereto to be turned off, wherein N is an integer greater than 0.

13. The data driving system of a liquid crystal display panel as claimed in claim 12, wherein one of said plurality of data driving chips that receives the clock signal, after receiving a Mth clock cycle of the clock signal, outputs the control signal to one or more data driving chips of said plurality of data driving chip that do not receive the clock signal, wherein M is a positive integer less than N, and the one or more data driving chips of said plurality of data driving chips that receive the control signal control the second transmission gate on the second signal line connected thereto to delay (N-M) clock cycles to be turned on, so that when the one or more data driving chips of said plurality of data driving chips that receive the clock signal control the first transmission gate on the first signal line connected thereto to be turned off, the data driving chip that receives the control signal controls the first transmission gate on the first signal line connected thereto to be turned on.

14. The data driving system of a liquid crystal display panel as claimed in claim 1, wherein one of said plurality of data driving chips that receives said predetermined data signal controls the first transmission gate on the first signal line connected thereto to be turned off after receiving said predetermined data signal, and transmits a control signal therefrom to one or more data driving chips of said plurality of data driving chips that do not receive said predetermined data signal, such that the one or more data driving chips of said plurality of data driving chips that receive the control signal controls the first transmission gate on the first signal line connected thereto to be turned on.

15. The data driving system of a liquid crystal display panel as claimed in claim 14, wherein said data driving system also comprises:

a plurality of second signal lines, which transmit a clock signal from said timing control chip to said plurality of data driving chips, wherein each of said plurality of second signal lines is connected between said timing control chip and a respective one of said plurality of data driving chips in order to transmit said clock signal to said plurality of data driving chips; and a plurality of second transmission gates, wherein each of said plurality of second transmission gates is provided on a respective one of said plurality of second signal lines.

16. The data driving system of a liquid crystal display panel as claimed in claim 15, wherein the first transmission gate on the first signal line connected to one of said plurality of data driving chips and the second transmission gate on the second signal line connected to the one of said plurality of data driving chips are simultaneously turned on or off.

17. The data driving system of a liquid crystal display panel as claimed in claim 16, wherein each of said plurality of data driving chips, after receiving an Nth clock cycle of the clock signal, controls the first transmission gate on the first signal line connected thereto to be turned off, wherein N is an integer greater than 0.

18. The data driving system of a liquid crystal display panel as claimed in claim 17, wherein one of said plurality of data driving chips that receives the clock signal, after receiving a Mth clock cycle of the clock signal, outputs the control signal to one or more data driving chips of said plurality of data driving chip that do not receive the clock signal, wherein M is a positive integer less than N, and the one or more data driving chips of said plurality of data driving chips that receive the control signal control the second transmission gate on the second signal line connected thereto to delay (N-M) clock cycles to be turned on, so that when the one or more data driving chips of said plurality of data driving chips that receive the clock signal control the first transmission gate on the first signal line connected thereto to be turned off, the data driving chip that receives the control signal controls the first transmission gate on the first signal line connected thereto to be turned on.

19. The data driving system of a liquid crystal display panel as claimed in claim 18, wherein one of said plurality of data driving chips is, in response to receiving a predetermined signal, controlling the second transmission gate on the second signal line connected thereto to be turned on.

20. The data driving system of a liquid crystal display panel as claimed in claim 15, wherein said clock signal and said predetermined data signal are respectively transmitted in a differential signal mode.

* * * * *